United States Patent [19]

Thayer

[11] Patent Number: 4,469,002

[45] Date of Patent: Sep. 4, 1984

[54] AXIAL FLOW VALVE

[76] Inventor: Orla E. Thayer, P.O. Box 475, Waldport, Oreg. 97394

[21] Appl. No.: 380,357

[22] Filed: May 21, 1982

Related U.S. Application Data

[63] Continuation-in-part of Ser. No. 320,000, Nov. 10, 1981, abandoned, which is a continuation-in-part of Ser. No. 74,553, Sep. 11, 1979, Pat. No. 4,299,156, which is a continuation-in-part of Ser. No. 927,565, Jul. 24, 1978, Pat. No. 4,213,371, which is a continuation of Ser. No. 764,028, Jan. 31, 1977, Pat. No. 4,112,806.

[51] Int. Cl.[3] ..... G10D 9/04

[52] U.S. Cl. ..... 84/390; 84/395

[58] Field of Search ..... 84/387–395

[56] References Cited

U.S. PATENT DOCUMENTS

| | | | |
|---|---|---|---|
| 105,059 | 7/1870 | Fietz | 84/392 |
| 455,562 | 7/1891 | Gates | 84/393 |
| 461,131 | 10/1891 | Pietz | 84/390 |
| 1,244,745 | 10/1917 | King | 84/391 |
| 1,428,675 | 9/1922 | Alschansky | 84/390 |
| 1,703,411 | 2/1929 | Steinmetz | 84/390 |
| 2,106,281 | 1/1938 | Sattler | 84/390 |
| 2,259,756 | 10/1941 | Lindsay | 84/388 |
| 2,794,358 | 6/1957 | Meredith | 84/388 |
| 3,175,449 | 3/1965 | Kravka | 84/390 |
| 3,641,863 | 2/1972 | Kanstul et al. | 84/390 |
| 3,780,756 | 12/1973 | Pennington | 137/119 |
| 3,886,837 | 6/1975 | Veneklasen | 84/388 |
| 3,933,078 | 1/1976 | Veneklasen | 84/387 |
| 4,047,459 | 9/1977 | Nakamura | 84/390 |
| 4,112,806 | 9/1978 | Thayer | 84/390 |
| 4,213,371 | 7/1980 | Thayer | 84/390 |
| 4,276,804 | 7/1981 | Holland | 84/394 |
| 4,299,156 | 11/1981 | Thayer | 84/390 |

FOREIGN PATENT DOCUMENTS

| | | | |
|---|---|---|---|
| 559300 | 9/1932 | Fed. Rep. of Germany | 84/392 |
| 760171 | 9/1980 | U.S.S.R. | 84/390 |

OTHER PUBLICATIONS

"The French Horn", by R. Morley-Pegge, London-/Ernst Benn Limited, New York/W. W. Norton & Company, Inc., pp. 25–29.

"A New Design Foundation for Brass-Wind Instruments" (published notes believed to be of a lecture delivered by Mark S. Veneklasen).

*Primary Examiner*—Lawrence R. Franklin

*Attorney, Agent, or Firm*—Klarquist, Sparkman, Campbell, Leigh & Whinston

[57] ABSTRACT

A rotary valve for selectively inserting and removing a slide loop from the sound path of a musical instrument is disclosed. The valve includes a rotor having an outer surface portion that is substantially conical and also includes a casing with a substantially conical inner surface portion that receives the outer surface portion of the rotor. Two sound passages entending through the rotor are no more than slightly curved. These passages align axially with the instrument's lead pipe, main bore, and slide loop ends so that a minimum of undesired harmonics are added to the tone of the instrument due to presence of the valve in the sound path.

23 Claims, 17 Drawing Figures

92
78
74
77
90
80
76
10
88

50
43
54
42
62
46
A1
52
61
60
70
67
40
63

10
14
74
78
80
35
16
12
27
38
35
36
37
40
61
62
46
43
40
50
42
54
44
68
52
63
65
60
64
70
30
A1
94
96
98
98
29
28

78
35
14
4
37
80
76
A1
35
16
10
12
70
74
96
29
94
28
36
4

80
78
5
24
26
10
14
74
94
70
29
28
98
29
98
5

12
60
40

34
50
78
42
10
76
6
74
60
32
24
44
52
38
65
A1
16
40
39
14
6
12
35
37
36

77
80
74
78
61
76
60
40
A1

77
80
74
78
61
40
60
A1
76

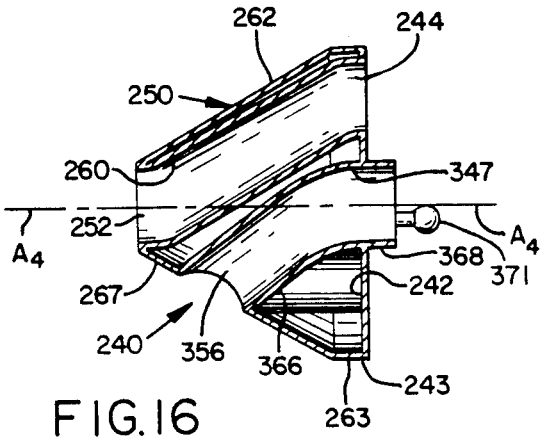
FIG.16
FIG.15
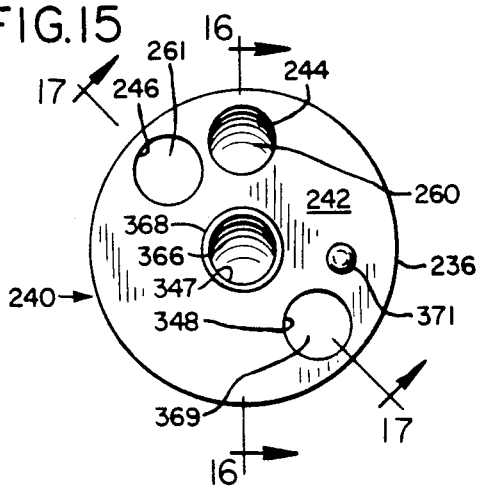
FIG.17
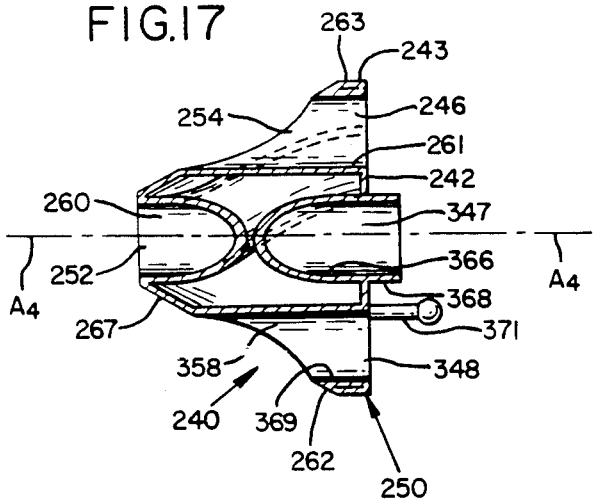

AXIAL FLOW VALVE

CROSS-REFERENCE TO RELATED APPLICATIONS

This is a continuation-in-part of application Ser. No. 320,000, filed Nov. 10, 1981, now abandoned, which is a continuation-in-part of application Ser. No. 074,553, filed Sept. 11, 1979, now U.S. Pat. No. 4,299,156, which is a continuation-in-part of application Ser. No. 927,565, filed July 24, 1978, now U.S. Pat. No. 4,213,371, which is a continuation of application Ser. No. 764,028, filed Jan. 31, 1977, now U.S. Pat. No. 4,112,806.

BRIEF SUMMARY OF THE INVENTION

This invention relates to a rotary fluid flow switch and more specifically to a rotary air valve of a musical instrument.

Rotary valves are highly regarded for use in musical instruments due to their quick action and relative simplicity of structure as compared to piston type valves. Some prior rotary valves are compact and lightweight, but suffer from the disadvantage that they add overtones to the sound of the instrument when played. These overtones are produced either inside the valve rotor or at the junction of the valve rotor with the instrument tubing, wherever there is a sharp bend or substantial variation in cross-sectional shape of the air passage. When sound waves traveling through an instrument's sound passage are required to make sharp turns or pass through regions of varying cross-sectional shape, certain portions of the waves reflect off the inside wall of the passage. Such a partial reflection reduces the energy of the fundamental wave and produces an undesirable overtone.

The present invention is a valve which adds few unwanted harmonics to a musical instrument's tone and weighs less than any prior valve of comparable acoustic quality. The lead pipe and main bore of the instrument align axially with the passages of the valve rotor so that the sound waves enter, pass through, and leave the valve without substantially changing direction or being deflected off the passage walls. Such a valve can be constructed with a rotor having only two passages, which extend straight through the rotor. Alternatively, one or both of such passages may be slightly curved.

The rotor has an outer surface portion that is tapered, preferably generally conical. This rotor is received by a casing having a flared inner surface portion that conforms in shape to the outer surface portion of the rotor. The tapered and flared surface portions engage each other such that the rotor is maintained in proper axial alignment during its rotation. Because the rotor rotates on a conical surface portion, the entire valve can fit within a casing that is generally conical in shape and has but a single casing end plate. Such a valve weighs less and occupies less volume than a cylindrical rotary valve of the same diameter. Because the entire valve can be tapered, at least one of the sound passageways can be very short and yet extend substantially straight through the rotor. The valve thus can be used to mount very short slide loops, with no reduction in sound quality.

A valve according to the present invention can have as few as three primary elements: (1) a casing having a flared inner surface; (2) a tapered rotor that fits in the casing and can be removed for cleaning; and (3) some means to releasably retain the rotor in the casing.

In one embodiment, the casing is partially closed at its base by an end wall; and the rotor is axially-truncated so that it can be removed through the uncovered portion of the casing base. Another embodiment includes a casing that is completely open at its base, the rotor being secured by an end plate detachably mounted over the opening by a threaded retainer ring.

It is an object of the present invention to provide a musical instrument rotary valve which is lightweight, of simple design, requires a minimum of parts, is inexpensive and easy to construct.

A further object is to provide such a valve with a rotor that can be easily removed for cleaning without the use of tools or with one simple tool at most.

Also, an object of the invention is to improve the acoustic performance of all valved brass wind instruments, such as trumpets, alto horns, French horns, trombones, baritones and tubas, by providing a valve which does not have the abruptly angled sound passages of most prior rotary and piston valves.

An additional object of this invention is therefore to provide a rotary valve having passages which extend in a straight or substantially straight path therethrough and are of a uniform circular cross section throughout their entire length.

Another object is to provide a rotary valve in which the instrument's lead pipe and main bore align axially with the passages through the valve's rotor.

Yet another object is to provide certain rotary valves where the lead pipe and main bore are in axial alignment with each other at the locations where they attach to the valve so that when the rotor is in one operating position there is a straight passage from the lead pipe to the main bore.

It is also an object to provide a rotary valve having inlet and outlet ports configured such that multiple valves can be located in close proximity with a substantially straight sound path extending from the lead pipe, through all of the valves, to the main bore.

A further object is to provide a rotary valve having a rotor which requires only two passages extending axially therethrough.

A still further object of the invention is to provide a rotary valve having a rotor passage which, at one end, is coaxial to the axis of rotor rotation.

Other objects, advantages and features of this invention will become apparent to those skilled in the art upon reading the following specification.

BRIEF DESCRIPTION OF THE DRAWING

In the drawing:

FIG. 15 is a partial, sectional view taken along line 15—15 of FIG. 13;

FIG. 16 is a sectional view of the valve rotor shown in FIG. 15 taken along lines 16—16 of FIG. 15, the view being a vertical sectional view of the rotor in a first or direct flow position; and FIG. 17 is a sectional view of the valve rotor shown in FIG. 15 taken along lines 17—17 of FIG. 15, the view being a vertical sectional view of the rotor in a second or diverted flow position.

DETAILED DESCRIPTION

Figure 1:
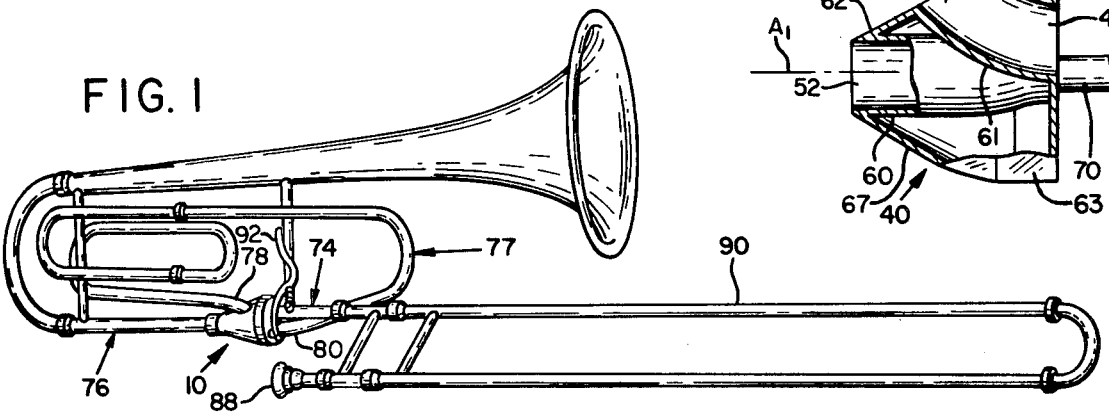
FIG. 1 is a side elevation of a B-flat trombone incorporating a first valve according to the present invention.

Rotary valves for selectively inserting and removing a slide loop from the sound path of a musical instrument are shown in U.S. Pat. No. 4,112,806 issued Sept. 12, 1978, U.S. Pat. No. 4,213,371, issued July 22, 1980, U.S. Pat. No. 4,299,156 issued Nov. 10, 1981, and U.S. patent application Ser. No. 320,000 filed Nov. 10, 1981, now abandoned; each of which issued patents and said application are incorporated herein by reference. Each such valve includes a rotor having at least two sound passages extending therethrough, which are no more than slightly curved. The passages align axially with the instrument's lead pipe, main bore, and slide loop ends so that a minimum of undesired harmonics are added to the tone of the instrument due to presence of the valve in the sound path. Each of these previous valves are simple in construction and have a superior sound path.

Valves according to the present invention have the aforesaid favorable features and new features which provide benefits of a different nature. A valve according to the present invention has a rotor with an outer surface which provides a contact face that is defined in a generally conical surface. The face may be defined in any tapered surface that is circular in right cross section; but a true cone is preferred. The rotor is contained within a casing which has an inner surface portion with a contact surface that conforms in shape to the same generally conical surface as does the rotor surface. Due to the conical shape of the contact surfaces, the rotor is self-centering within the casing and will have a low mass and thus a low inertia. The lightweight rotor responds to an instrumentalists finger movements more quickly than prior rotors of greater mass.

Because they can be constructed using a minimum number of parts, valves according to the present invention can be very low in total weight. One preferred valve has only three basic separable parts, a casing, a door plate, and a rotor, as shown in FIGS. 1-7 of the drawing. The valve shown in FIGS. 10-12 has only a casing, a door plate, a rotor and a retaining ring. Despite the simplicity and low weight of such preferred valves, each has a rotor that is easily removable for cleaning.

As illustrated in FIGS. 1-7, a first valve according to the present invention has a casing 10 which includes a substantially frustoconical casing wall 12 having a base end and a narrowed end, a sleeve 16 secured on the narrowed end, and a transverse casing end plate 14 fixed on the base end of the casing. The end plate 14 has flat surfaces positioned perpendicular to a longitudinal axis "$A_1$" of the casing and defines two casing end plate apertures. One of the end plate apertures is a primary casing end plate aperture 24 having an axis which is parallel to but displaced from the axis "$A_1$". The other is a secondary casing end plate aperture 26 the center of which is displaced an equal distance away from the longitudinal axis "$A_1$" as is the center of the primary casing end plate aperture 24.

Figure 2:
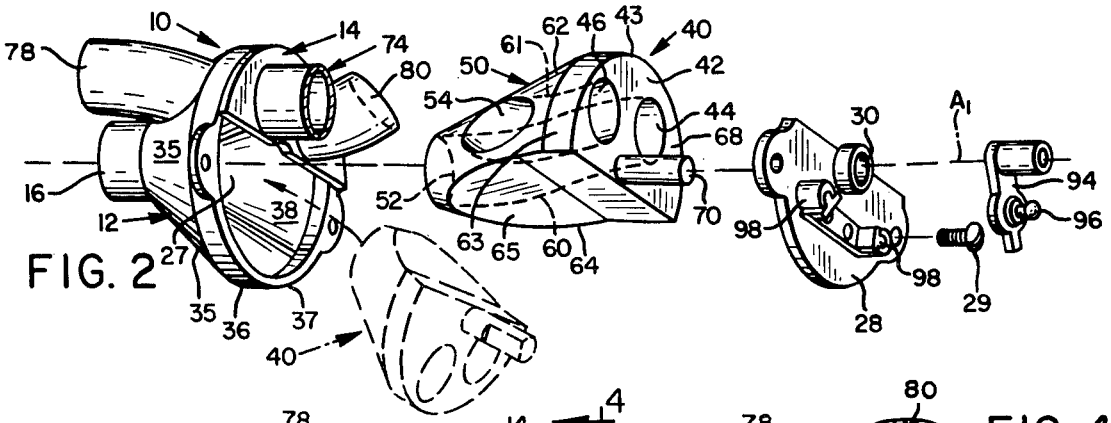
FIG. 2 is an enlarged, isometric, exploded view of the valve shown in FIG. 1.
Figure 3:
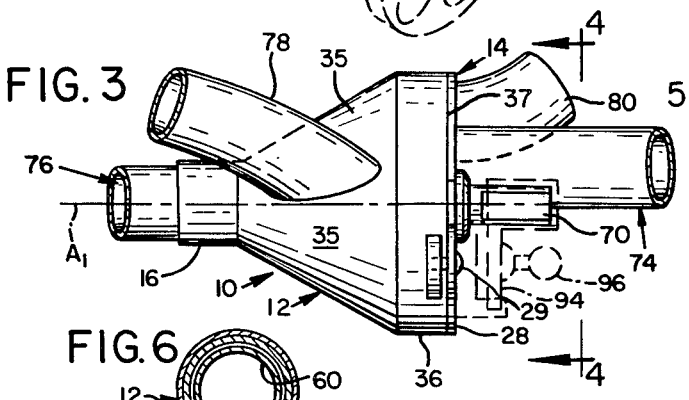
FIG. 3 is a plan view on a further enlarged scale of the valve shown in FIGS. 1 and 2.
Figure 4:
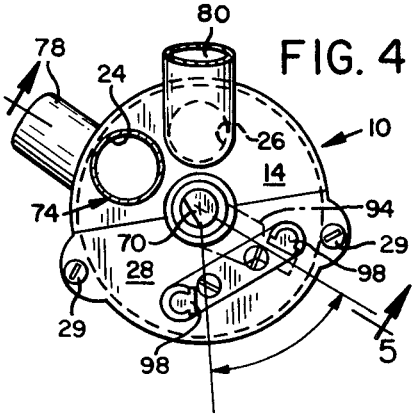
FIG. 4 is a sectional view taken along line 4—4 of FIG. 3.

The end plate 14 of the casing shown in FIGS. 1-6, only partially closes the base end of the casing. As best seen in FIG. 2, the end plate 14 leaves an opening 27 into the casing through which the rotor may be removed for inspection and cleaning. In order to allow sufficient room for the passage of the rotor, it is preferred that the end plate 14 cover an area contained entirely within two adjacent quadrants of the base end of the casing. A door plate 28 mounts detachably alongside the end plate 14 over the opening 27 at the one end of the casing wall 12 and is held in place by screws 29. The door plate 28 includes a circular shaft aperture 30 which is positioned coaxially to the longitudinal axis "$A_1$" when the door plate is mounted on the casing wall 12. The sleeve 16 defines a circular, axial casing frustrum aperture 32 coaxially aligned with the longitudinal axis "$A_1$" of the casing wall 12. The casing wall 12 defines a casing wall aperture 34 at a location between the casing ends.

The casing wall 12 includes a right frustoconical portion 35 and a cylindrical portion 36 which extends from the base of the frustoconical portion 35 to a circular casing outer end 37 which is the base end of the casing wall 12. The frustoconical portion 35 and cylindrical portion 36 have a common axis which coincides with the axis "$A_1$".

Inside the casing are two opposed interior contact faces. The interior of the casing wall 12 provides one interior contact face which is an area defined in a tapered surface of circular cross section. In the illustrated embodiment, the frustoconical portion 35 has a flared, substantially conical inner surface 38 that provides the one contact face and which serves as a coaxial, concave seat for the rotor. The other contact face is the inner surface 39 of the casing end plate 14.

A substantially frustoconical rotor indicated generally at 40, is located inside the casing. At one end of the rotor 40 is a rotor end plate 42 having a curved edge portion 43 in a radius slightly less than the greatest inside radius of the casing wall 12. This rotor end plate is positioned with one of its flat surfaces adjacent inner surface 39 of the casing end plate 14. The rotor end plate 42 includes a primary rotor end plate aperture 44 adapted to register alternately with the primary casing end plate aperture 24 when the rotor is in a first position and with the secondary casing end plate aperture 26 when he rotor is in a second position. The rotor end plate 42 also includes a secondary rotor end plate aperture 46 which is positioned to register with the primary casing end plate aperture 24 when the rotor is in the second position.

Extending from the rotor end plate 42 to the other end of the rotor is a rotor wall 50 which defines a rotor frustrum aperture 52 at the end opposite the rotor end plate 42. The wall has a tapered, arcuate outer surface. In the illustrated embodiment, the rotor wall 50 is substantially frustoconical. A rotor wall aperture 54 is defined in the wall 50 at a location between the rotor ends.

The illustrated casing wall 12 has an inner surface at least a portion of which has the shape of a circular cone with the same angle of generation as that of the conically-shaped portion of the surface of the rotor wall 50. The conical surface portion of the wall 50 seats against the conical surface portion of the casing wall 12 so that the rotor frustrum aperture 52 remains in alignment with the casing frustrum aperture 32 at all times. The rotor wall aperture 54 registers with the casing wall aperture 34 only when the rotor 40 is in the second position. When the rotor is in the second position, each of the rotor apertures registers with a casing aperture. The rotor apertures and the casing apertures preferably correspond exactly in size and shape to one another to minimize the resistance to soundwaves passing between the casing and rotor.

Rotor tubes provide passages for air traveling through the rotor 40. A rigid primary rotor tube 60 extends through the rotor and connects the primary rotor end plate aperture 44 with the rotor frustrum aperture 52. Optionally, a cylindrical extension (not shown) of the primary rotor tube 60 could extend into the casing axial aperture 32 so that the extension would be journaled within the aperture 32 and the sleeve 16.

Figure 7:
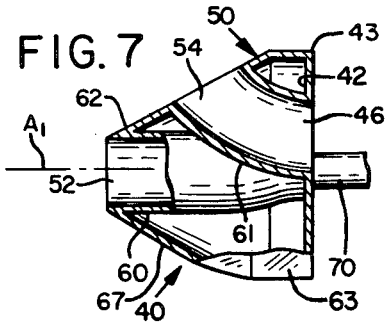
FIG. 7 is a vertical, sectional view of the rotor shown in FIG. 5, the rotor being shown as rotated to a second or diverted flow position.

A rigid secondary rotor tube 61 extends through the rotor and connects the secondary rotor end plate aperture 46 to the rotor wall aperture 54. The axis of this secondary rotor tube 61 is substantially perpendicular to the rotor end plate 42 where they join and is coaxial with the secondary rotor end plate aperture 46. Where the secondary rotor tube 61 joins the rotor wall aperture 54, they are coaxial. At this location, the secondary rotor tube 61 of the illustrated embodiment extends radially outwardly at an acute angle to the axis "$A_1$" as best seen in FIG. 7. Although hollow tubes provide the sound passages of the preferred rotor, other constructions could be used. For instance, a solid rotor having passages extending therethrough, would be suitable but not preferred due to its greater mass.

The illustrated rotor is specifically shaped for use in the casing previously described. The rotor wall 50 includes a right frustoconical portion 62 having a base end and a narrowed end, and a right cylindrical portion 63 which extends from the base of the frustoconical portion 62. The rotor end plate 42 is secured to the outer end of the cylindrical portion 63. The frustoconical portion 62 and cylindrical portion 63 have a common axis which coincides with the axis "$A_1$" when the rotor is installed inside the casing.

To lower rotor size and weight and allow for easy removal, the rotor wall 50 is axially-truncated so that it has an axially-extending edge 64. An axially extending rotor side wall 65 is mounted on the rotor wall 50 at the edge 64 to enclose the rotor. A transverse section of the rotor, taken through the rotor side wall 65, would show the outer surface of the rotor as a major arc formed by the rotor wall 50 and a secant formed by the side wall 65.

Figure 6:
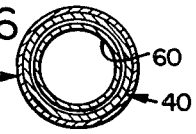
FIG. 6 is a sectional view taken along line 6—6 of FIG. 5.
Figure 5:
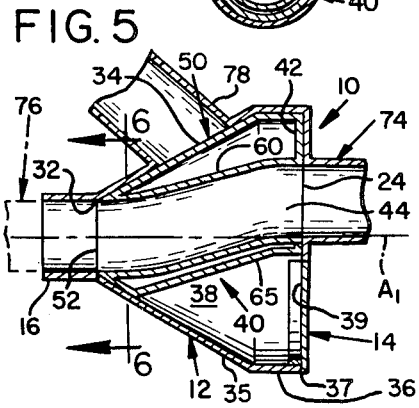
FIG. 5 is a sectional view taken along line 5—5 of FIG. 4, the view including a vertical sectional view of a rotor in a first or direct flow position.

The rotor has two opposed exterior contact faces which face the interior contact faces of the casing. The outside of the rotor wall 50 provides one exterior contact face which is an area defined in a tapered surface of circular cross section that conforms to the surface which defines the one interior contact face of the casing. In the illustrated rotor, the substantially conical outer surface 67 of the frustoconical portion 62 provides a contact face that mates with the inner surface 38 of the casing. Specifically, the tapered outer surface 67 seats in the rotor seat formed by inner surface 38 so that the rotor is centered for rotation relative to the casing. Proper rotor alignment is best achieved if at least a portion of each tapered contact face is a major arc in cross section. Preferably a portion of at least one of said contact faces is a complete circle in cross section at the narrowed ends of the casing and rotor as shown in FIG. 6. The other rotor contact face is provided by the outer surface 68 of the rotor end wall 42 and is positioned to face the inner surface 39 of the casing end wall 14.

A shaft 70, extending from the outer side of the rotor end plate 42, is coaxial to the longitudinal axis "$A_1$". The shaft 70 extends through the shaft aperture 30 so that the rotor can be rotated about the axis "$A_1$" by rotating the shaft 70.

The best tone quality is achieved if sound waves traveling through the valves of the musical instrument encounter a minimum amount of resistance. By mounting the instrument tubes so that their axes register with the tube axes at the points where the tubes are mounted on the casing, a minimum amount of resistance is encountered during the transfer of sound waves between the instrument tubes and the rotor passages. Resistance inside the rotor passages is low because the tubes 60, 61 are substantially straight and of a uniform, circular cross section throughout their entire length.

The primary rotor tube 60 is shaped as a slight S-curve and has end portions positioned to be subtantially parallel to the axis "$A_1$". An alternative to the S-shaped primary rotor tube 60 is a straight tube (not shown) extending diagonally between the primary rotor end plate aperture 44 and the rotor frustrum aperture 52. Such a diagonal tube would provide a substantially straight soundpath; but the ends of such a straight diagonal primary rotor tube would not align axially with the illustrated instrument tubes so there would be some resistance to the transfer of sound waves between the primary rotor passage and the instrument tubes.

The secondary rotor tube 61 curves gently as it extends between the secondary rotor end plate aperture 46 and rotor wall aperture 54. It is desirable to maximize the radius of curvature to minimize resistance. Because it extends through a conically shaped portion of rotor wall 50, the tube 61 can have a large radius of curvature or even be straight (not shown). The conical shape of the valve illustrated is also advantageous because, at a given tube size, such a valve occupies less space and weighs less than any other valve having comparably straight sound passages.

Such valves according to the present invention are well suited for use in compact instruments and instruments requiring short slide loops. The distance between the primary rotor end plate aperture 44 and rotor wall aperture 54 is so little that even the shortest slide loop can be positioned with its ends in registry with those apertures.

Instrument tubes are mounted to the casing so that they connect with the casing apertures. Preferably the tubes and apertures are in axial alignment so that a minimum amount of resistance is encountered during the transfer of sound waves between the instrument tubes and the rotor passages. The drawing figures show the first valve according to the present invention connected with tubes which correspond to the tubes of a musical instrument. A lead pipe 74 and main bore 76 connect to opposite ends of the casing. The lead pipe 74 extends from the mouthpiece of the instrument and is connected to the primary casing end plate aperture 24 which is located at a first of the opposite ends of the illustrated casing. The main bore 76 of the instrument connects to the casing frustrum aperture 32 which is located at a second of the opposite ends of the illustrated casing. A slide loop 77 has opposite ends 78, 80 which connect to the casing wall aperture 34 and the secondary casing end plate aperture 26 which is at one of the opposite ends, in this instance the first of such ends.

FIG. 1 depicts a valve according to the present invention incorporated in a musical instrument. More specifically, FIG. 1 shows a B-flat trombone which includes a single slide loop 77. By rotating the valve, the slide loop 77 may be added to the sound path so that the fundamental pitch of the trombone is lowered to the key of E-flat. The trombone has a mouthpiece 88 and a slide 90 which are portions of the lead pipe 74. The lead pipe connects to the primary casing end plate aperture 24 of the valve. One end 78 of the slide loop 77 is connected to the casing wall aperture 34. The other end 80 is connected to the secondary casing end plate aperture 26. The main bore 76 is connected to the casing frustrum aperture 32.

Means are provided on the instrument for rotating the valve shaft and rotor. Such rotating means can be of a common variety, as shown in FIG. 1, that employs a finger actuated key 92 rotatably mounted to a brace of the instrument and mechanically connected to the shaft 70 in such a manner that movement of the key causes rotation of the shaft. FIG. 2 shows an arrangement where a crank 94 connects to the shaft and has a ball 96 which forms a part of a ball joint with a linkage (not shown) which connects with the finger actuated key. One or more stops 98 may be provided to limit movement of the crank 94 and thereby assure positive alignment between rotor apertures and casing apertures.

Figure 9:
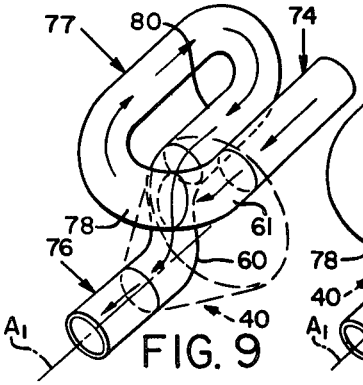
FIG. 9 is an isometric schematic view showing the flowpath of the valve of FIG. 8 with the rotor in a second or diverted flow position.
Figure 8:
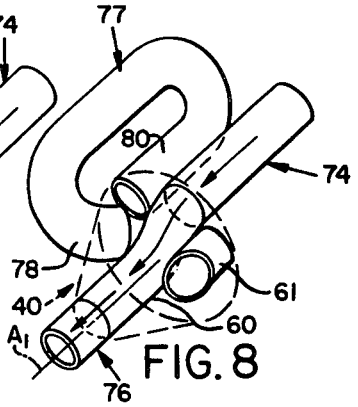
FIG. 8 is an isometric schematic view showing the flowpath of a valve according to the present invention with a rotor in a first or direct flow position.

When the instrumentalist moves the key 92, the rotor rotates about the longitudinal axis "$A_1$" between the positions illustrated in FIGS. 8 and 9 wherein the rotor 40 appears in broken lines. FIG. 8 shows the rotor in the normal flow or first position. In this position, the primary rotor tube 60 connects the lead pipe 74 directly to the main bore 76.

By depressing the key 92, the rotor is rotated about the axis "$A_1$" to the second or diverted flow position shown in FIG. 9; the secondary rotor tube 61 connects the lead pipe 74 with one end 78 of the slide loop; and the primary rotor tube 60 connects the other end 80 of the slide loop with the main bore 76. Thus, when the valve is in the first position, the sound waves can travel directly between the lead pipe 74 and the main bore 76. When the valve is in the second position, sound waves must pass through the slide loop 77 when traveling between the lead pipe 74 and the main bore 76.

The rotor may be removed for inspection and cleaning by removing the screws 29 and disconnecting the crank 94 from the shaft 70. When this is done, the door plate 28 can be removed to release the shaft 70. Using the fingers, the shaft is rotated until the rotor end plate 42 aligns with the opening 27 through the base of the rotor casing whereupon the rotor can be pulled out through the opening.

To reinstall the rotor, the procedure is reversed. The rotor is held in the position shown by broken lines in FIG. 2, and pushed through the opening to the point where the conical surfaces engage. Once inserted, the rotor is finger-rotated to its operating position after which the door plate 28, screws 29, and crank 94 are returned to their places.

Figure 10:
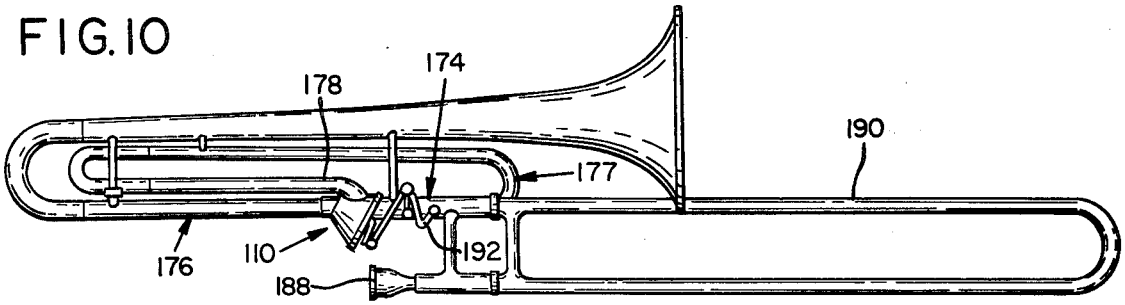
FIG. 10 is a side elevation of a B-flat trombone incorporating a second valve according to the present invention.
Figure 11:
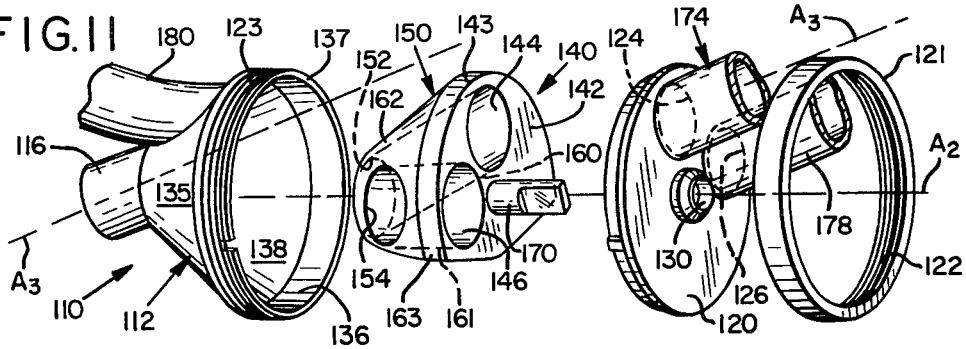
FIG. 11 is an enlarged, isometric, exploded view of the valve shown in FIG. 10.
Figure 12:
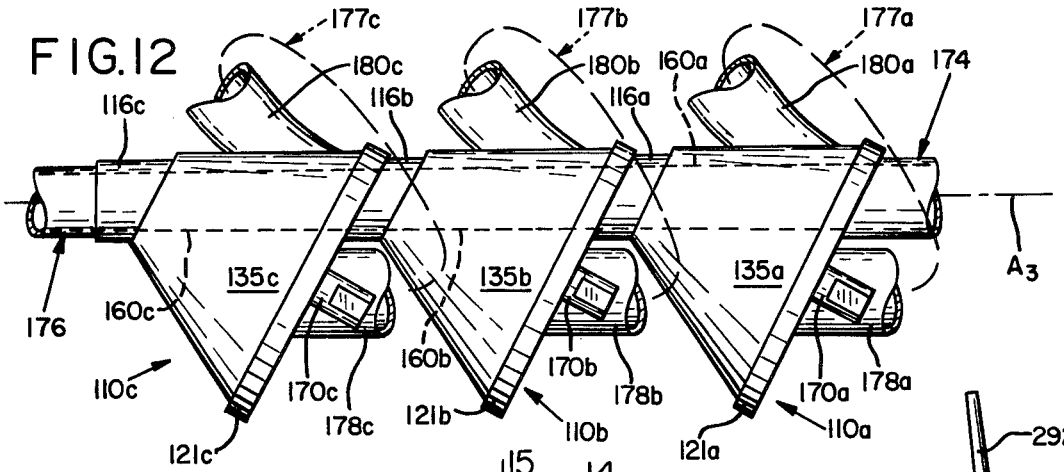
FIG. 12 is a fragmentary plan view of a musical wind instrument incorporating three of the valves shown in FIG. 10 in series.

FIGS. 10–12 illustrate a second valve according to the present invention which is closely related to the valve shown in FIGS. 1–7. Each feature of the second valve that is common to a feature of the first valve bears the same reference numeral incremented by one hundred. The second valve has a casing 110 with a substantially frustoconical wall 112 with a longitudinal axis "$A_2$". An end plate 120 having flat surfaces positioned perpendicular to the axis "$A_2$" defines the two casing end plate apertures 124, 126, displaced an equal distance away from the longitudinal axis "$A_2$". The casing shown in FIGS. 10–12 has an end plate 120 which closes the base end of the casing. A retainer ring 121 secures the end plate 120 to the casing wall 112. The ring has interior threads 122 which mate with exterior threads 123 on the casing wall 112. The end plate 120 includes a circular shaft aperture 130 which is positioned coaxially to the longitudinal axis "$A_2$" when the end plate is mounted on the casing wall 112.

A sleeve 116 defines a circular, axial casing frustrum aperture (not shown) that is coaxially aligned with the longitudinal axis "$A_2$" of the casing wall 112. Unlike other embodiments, however, the sleeve 116 has an axis "$A_3$" at an acute angle to the axis of rotation "$A_2$". As seen in FIGS. 11 and 12, the lead pipe 174 and main bore 176 are also coaxial to axis "$A_3$", as is the primary rotor tube 160 when the valve is in the first or direct flow position.

This is a particularly desireable valve geometry since, when the valve is in the first position, the sound path from the lead pipe 174 through the valve to the main bore 176 is completely straight. When a note is played with the rotor in the first position, this valve adds no coloration to the sound whatsoever, and the instrument behaves like a straight, or valveless instrument.

When the rotor is moved to the second or diverted flow position, there is a slight bend in the sound path at the junction of the primary rotor tube 160 and the main bore 176. But, this bend is minor, particularly in comparison to the sound paths through the most commonly used valves. And, there is a straight path through the primary rotor tube 160 into the one end 178 of the slide loop. There is also a straight path that extends from the interior of the secondary rotor tube 161 and into the other end 180 of the slide loop. Thus, even when the rotor is in its second position, there need be no more than one slight bend in each of the sound paths at the junctions of instrument tubes with the valve casing.

Many instrumentalists would find this embodiment, with its completely straight sound path in the first position, to be superior to the embodiment shown in FIGS. 1–7, wherein there is a slight S-curve in the primary rotor tube 60. Such an instrument would have a tone quality equal to a straight horn when the valve was not in use, and the sound quality is extremely good even when the valve is rotated to its second position.

It is another advantage of the valves shown in FIGS. 10–12 that it can be positioned very closely to other, similar valves. Thus, in a trumpet or french horn, three valves can be arranged in close proximity along axis "$A_3$" as shown in FIG. 12. It can be seen that the sound path from the lead pipe 174 to the main bore 176 is a straight line through each of the three primary rotor tubes 160*a*, 160*b*, 160*c*. The instrument pipes which lead to and from the valves are at convenient angles. And, the valve shafts 170*a*, 170*b*, 170*c* are each at an accessible location and angle. Thus, valves according to the embodiment of FIGS. 10–12 are particularly convenient for use in instruments where multiple valves are required.

The rotor 140 illustrated in FIG. 11 is axially-truncated to minimize mass, but could be a whole cone. In this valve, the rotor need not pass through a small opening if it is to be inspected and cleaned. Instead, one merely disconnects a finger key linkage (not shown) from the shaft 170 and rotates the retainer ring 121 until is disengages the threads 123. The end plate 120, lead pipe 174 and one end 178 of the slide loop are then pulled away from the casing wall 112, main bore 176 and other end 180 of the slide loop to provide access for removal of the rotor 140. To reassemble the valve, the procedure is reversed. The end plate 120, casing outer end 137, and shaft 170 are keyed so that each element of the valve will be in proper alignment after assembly.

A third valve according to the present invention is shown in FIGS. 13–17. This valve is a dual valve which includes an additional pair of rotor tubes and additional sets of rotor and body apertures.

Certain types of instruments require such dual valves, the most notable being the double french horn and double baritone. Such an instrument is fitted with two sets of valves with their associated slide loops. Each set of valves is provided with a separate set of slide loops of lengths for one of two specific keys or pitches. As an example, in the usual double French horn, a primary set of valves may control loops which pitch the instrument in the key of F, while the secondary set of valves may control loops which pitch the instrument in the key of B-flat. An additional diverter valve is provided to direct the sound path through the desired set of valves. In practice, each valve is a dual valve which includes two single valves, one from each set, which are linked together so that a single set of finger keys can operate the valves of both the primary and secondary sets.

Dual valves are also utilized in a specific class of instruments called compensating horns. In these it has been found desireable to "compensate" for overall length deficiencies when more than one valve is operated at a time. This compensation is accomplished by providing dual valves to add small secondary slide loops to the sound path when more than one valve is functioning. Because compensating horns have previously used two standard single valves linked together to make dual valves, such compensating horns have, of necessity, include tortuous sound paths. A dual valve according to the present invention is advantageous in such compensating horns because it includes two single, axial valves in one valve body to simultaneously control the inclusion of both the primary and the secondary slide loop. Such a dual valve reduces the number of valve bodies needed in a compensating horn, and also lessens the tortuousness of horn's sound path.

In the illustrated dual valve, features common to the first valve according to the present invention have the same reference numerals incremented by two hundred. Features common to the second valve have the same reference numerals incremented by one hundred.

The valve has a casing 210 which includes a substantially frustoconical wall 212 having a base end and a narrowed end. A sleeve 216 is secured on the narrowed end; and a transverse casing end plate 220 is fixed on the base end of the casing by a retainer ring 221. The end plate 220 has flat surfaces positioned perpendicular to the longitudinal axis "$A_4$" of the casing and defines four casing end plate apertures. One of the end plate apertures is the primary casing end plate aperture 224. Another is a secondary casing end plate aperture 226, the center of which is displaced an equal distance away from the longitudinal axis "$A_4$" as is the center of the primary casing end plate aperture 224. A circular tertiary end plate aperture 328 is aligned coaxially with the longitudinal axis "$A_4$". Also defined by the end plate is a quatenary end plate aperture 329.

The sleeve 216 defines a circular casing frustrum aperture coaxially aligned with a longitudinal axis "$A_4$" of the casing wall 212. The casing wall 212 defines primary, secondary and tertiary casing wall apertures (not shown) at different locations between the casing ends.

The substantially frustoconical rotor 240 is located inside the casing. One end of the rotor 240 is a rotor end plate 242 having a circular edge portion 243 in a radius slightly less than the greatest inside radius in the casing wall 212. The rotor end plate 242 includes a primary rotor end plate aperture 244 adopted to register alternatively with the primary casing end plate aperture 224 when the rotor is in a first position and with the secondary casing end plate aperture 226 when the rotor is in a second position. A secondary rotor end plate aperture 246 is positioned to register with the primary casing end plate aperture 224 when the rotor is in a second position.

The rotor end plate 242 also defines a tertiary rotor end plate aperture 347 which is coaxially aligned with the tertiary body end plate aperture 328 at all times. A quatenary rotor end plate aperture 348 registers with the quatenary casing end plate aperture 329 only when the rotor 240 is in the second position.

Extending from the rotor end plate 242 to the other end of the rotor, is a rotor wall 250 which defines a rotor frustrum aperture 252 at the opposite end from the rotor end plate 242. A primary rotor wall aperture 254, a secondary rotor wall aperture 356 and a tertiary rotor wall aperture 358 are each defined in the wall 250 at locations between the rotor ends. The conical surface portion of the wall 250 seats against the conical surface portion of the casing wall 212 so that the rotor frustrum aperture 252 remains in alignment with the casing frustrum aperture at all times.

The primary rotor wall aperture 254 registers with the primary casing wall aperture only when the rotor is in the second position. The secondary rotor wall aperture 356 is adapted to register alternatively with the secondary casing wall aperture when the rotor is in a first position and with the tertiary casing wall aperture when the rotor is in the second position. The tertiary rotor wall apertue 358 is positioned to register with the secondary casing wall aperture when the rotor is in the second position. Thus, when the rotor is in the second position, each of the rotor apertures registers with a casing aperture. The rotor apertures and the casing apertures preferably correspond exactly in size and shape to one another to minimize the resistance to sound waves passing between the casing and the rotor.

As in the other valves, rotor tubes provide passages for air traveling through the rotor 240. A rigid primary rotor tube 260 extends through the rotor and connects the primary rotor end plate aperture 244 with the rotor frustrum aperture 252. Optionally, a cylindrical extension (not shown) of the primary rotor tube 260 could extend into the casing axial aperture so that the aperture would be journaled within the casing aperture. A rigid secondary rotor tube 261 extends through the rotor and connects the secondary rotor end plate aperture 246 to the primary rotor wall aperture 254. The second rotor tube 261 can be substantially straight and parallel to the axis "$A_4$" as illustrated, or could be in some other configuration, e.g, curved to extend radially outwardly at an acute angle to the axis "$A_4$" (not shown). A tertiary rotor tube 366 extends through the rotor and connects the tertiary rotor end plate aperture 347 with the secondary rotor wall aperture 356. Preferably, a cylindrical extension 368 of the tertiary rotor tube 366 further extends through the tertiary casing end plate aperture 328 so that the extension 328 is journaled within the aperture 328. A quatenary rotor tube 369 extends through the rotor and connects the quatenary rotor end plate aperture 348 with the tertiary rotor wall aperture 358 as shown in FIG. 17.

Because, at each end of the rotor there is an aperture at the axis of rotation, there is no axial shaft to rotate the rotor. Instead, there is an arm 371 mounted on the rotor to extend through a slot 372 in the casing end plate 220.

Figure 13:
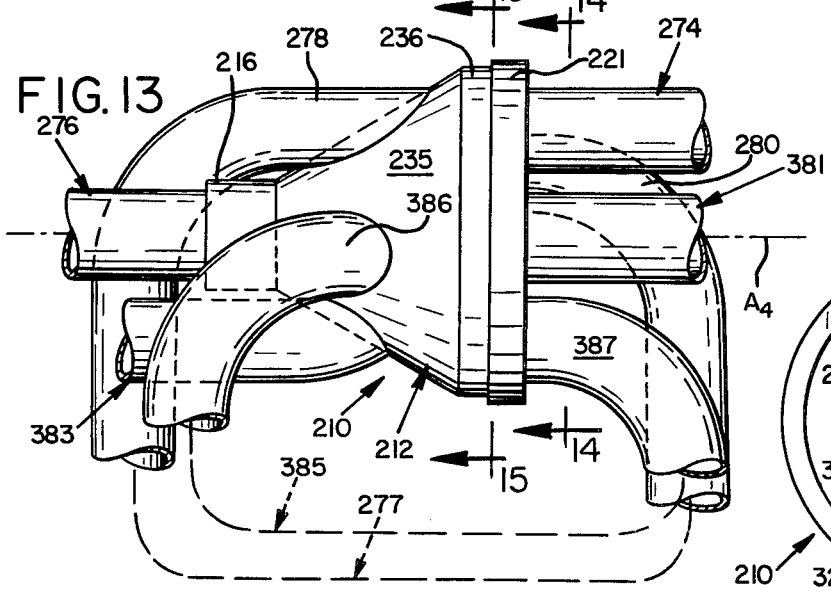
FIG. 13 is a fragmentary plan view of a musical wind instrument incorporating third valve according to the present invention for simultaneously engaging two slide loops.

FIG. 13 shows how instrument tubes mount to the third valve according to the present invention. A primary lead pipe 274 and primary main bore 276 connect at opposite ends of the casing. The primary lead pipe 274 is connected to the primary casing end plate aperture 224. The primary main bore 276 is connected to the casing frustrum aperture. A primary slide loop 277 has opposite ends 278, 280 which connect to the primary casing wall aperture, and the secondary casing end plate aperture 226. A secondary lead pipe 381 connects to the tertiary casing end plate aperture 328. A secondary main bore 383 connects to the second casing wall aperture. A secondary slide loop 385 has opposite ends 386, 387 which connect to the tertiary casing wall aperture and the quatenary end plate aperture 329. One or both sets of instrument pipes could be reversed whereby sound waves would move through the rotor tubes in the opposite directions.

Figure 14:
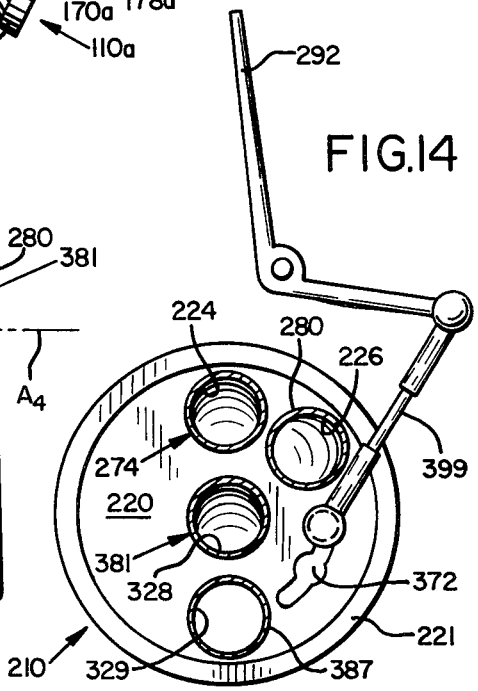
FIG. 14 is a sectional view taken along line 14—14 of FIG. 13.

As in other valves according to the invention, the mechanical means for rotating the valve can be of a common variety. As shown in FIG. 14, a finger actuated key 292 can be rotatably mounted to a brace on the musical instrument and mechanically connected to the arm 371 in such a manner that movement of the key causes rotation of the rotor. The key 292 is connected to the arm 371 by linkage arm 399 having a ball joint at each end. Stops (not shown) limit the movement of the arm 371 and thereby assures positive alignment between the rotor apertures and the casing apertures when the rotor is in each operation position.

When an instrumentalist moves the key 292, the rotor rotates about the longitudinal axis "$A_4$". When the rotor is in a first, or normal flow position, the primary rotor tube 260 connects the primary lead pipe 274 directly to the primary main bore 276. And, the tertiary rotor tube 366 connects the secondary lead pipe 381 directly to the secondary main bore 383.

By depressing the key 292 the rotor is rotated about the axis "$A_4$" to the second or diverted flow position wherein the secondary rotor tube 261 connects the primary lead pipe 274 with one end 278 of the primary slide loop; and the primary rotor tube 260 connects the other end 280 of the primary slide loop with the primary main bore 276. Also, when the rotor is in the second position, the tertiary rotor tube 366 connects the secondary lead pipe 381 with one end 386 of the slide loop 385; and the quatenary rotor tube 369 connects the other end 387 of the secondary slide loop with the secondary main bore 383.

Thus, when the valve is in the first position the sound waves can travel directly between the primary lead pipe 274 and primary main bore 276; they also can travel directly between secondary lead pipe 381 and second main bore 383. When the valve is in the second position, sound waves must pass through the primary slide loop 277 when traveling between the primary lead pipe 274, and the primary main bore 276. Likewise, sound waves must pass through the secondary slide loop 385 when traveling between the secondary lead pipe 381 and the secondary main bore 383.

While I have shown and described preferred embodiments of my invention, it will be apparent to those skilled in the art that changes and modifications may be made without departing from my invention in its broader aspects. For example, efficient operation of valves according to the present invention is not affected by reversing the structure so that the lead pipe of a musical instrument is connected to the frustrum aperture and the main bore is connected to the primary casing end plate aperture. In the dual valve of FIG. 13, either one of both pairs of instrument tubes may be reversed. Such reversed valves will operate in substantially the same fashion as the valves illustrated, except that the flow of sound waves through the valve will be reversed.

I claim:

1. A rotary valve for a musical wind instrument having a slide loop, an instrument pipe with a mouthpiece at one end and an instrument pipe terminating in an instrument bell, said valve comprising:

a casing including (a) a substantially frustoconical casing wall having a base and a narrowed end, said wall defining two casing wall apertures, each at a location between said base and said narrowed end, and (b) a transverse casing end plate at said base of said wall, said end plate defining two end plate apertures; and a substantially frustoconical rotor rotatable in said casing having (a) a rotor passage which connects said one of said end plate apertures to one of said casing wall apertures when said rotor is in a first position and which connects said one of said end plate apertures with the other of said casing wall apertures when said rotor is rotated to a second position, and (b) a rotor passage which connects said other of said end plate apertures to said one of said casing wall apertures when said rotor is in said second position, said one of said end plate apertures connecting to one of said instrument pipes, said one of said casing wall apertures connecting to the other of said instrument pipes, said other of said end plate apertures connecting to one end of said loop, and said other of said casing wall apertures connecting to the other end of said loop.

2. A musical wind instrument comprising:

a lead pipe having a mouthpiece at one end thereof;

a main bore terminating in an instrument bell;

a slide loop;

a casing having (a) first and second opposite ends, and (b) a casing wall extending between said opposite ends, said lead pipe being connected to said casing at said first end, said main bore being connected to said casing at said second end, one end of said loop being connected to said casing at one of said opposite ends, and the other end of said loop being connected to said casing between said ends at said casing wall, said wall having an interior contact face comprising at least one area defined in a surface of circular cross-section, which surface tapers directly toward the region where one of said lead pipe and said main bore connect to said casing; and a rotor rotatable in said casing having (a) an exterior contact face mating with said interior contact face for rotational movement therealong, (b) a primary rotor passage which directly connects said lead pipe to said main bore when said rotor is in a first position and which connects said one end of said loop to said one of said lead pipe and said main bore when said rotor is rotated to a second position, and (c) a secondary rotor passage which connects the other of said lead pipe and said main bore to said other end of said loop when said rotor is in said second position.

3. The instrument of claim 2 wherein:

said casing wall includes a right frustoconical portion which has a base and a narrowed end and which provides said interior contact face;

said casing includes an end plate which partially covers and yet leaves an opening in said base;

said rotor includes a rotor wall which has a right frustoconical portion providing said exterior contact face, said frustoconical portion being axially-truncated so that said rotor is small enough to pass through said opening; and said instrument further comprises openable door means for retaining said rotor in said casing and maintaining said rotor in axial alignment.

4. The instrument of claim 2 wherein at least a portion of each said contact face is a major arc in a plane perpendicular to the axis of said contact faces.

5. The instrument of claim 2 wherein at least a portion of at least one of said contact faces is a complete circle in cross section.

6. The instrument of claim 4 or 5 wherein said portion is near said narrowed end of said tapered surface.

7. The instrument of claim 2 wherein the faces are defined in identical conical surfaces.

8. The instrument of claim 2 wherein said casing further comprises an end plate at said one of said opposite ends of said casing, said end plate defining apertures which register with said rotor passages when said rotor is in said second position.

9. The instrument of claim 2 wherein;

said casing wall is circular in cross section at said one of said opposite ends;

said casing includes an end plate which covers less than half of said one of said opposite ends, leaving an opening in the casing at said one of said opposite ends; and said rotor is sufficiently small to pass through said opening.

10. The instrument of claim 9 further comprising door means to openably cover said opening.

11. A musical wind instrument comprising:

a lead pipe having a mouthpiece at one end thereof;

a main bore terminating in an instrument bell;

a slide loop;

a casing having (a) first and second opposite ends, and (b) a casing wall between said opposite ends, said lead pipe being connected to said casing at said first end, said main bore being connected to said casing at said second end, one end of the loop being connected to said casing at of one of said opposite ends, and the other end of said loop being connected to said casing at said casing wall, said casing wall having an inner surface shaped to provide a rotor seat which tapers directly toward the region where one of said lead pipe and said main bore connects to said casing; and a rotor rotatable in said casing having (a) a tapered outer surface that seats against said inner surface for rotational movement in said casing, (b) a primary rotor passage which directly connects said lead pipe to said main bore when said rotor is in a first position and which connects said one end of said loop to said one of said lead pipe and said main bore when said rotor is rotated to a second position, and (c) a secondary rotor passage which connects the other of said lead pipe and said main bore to said other end of said loop when said rotor is in said second position.

12. A musical wind instrument comprising:

a lead pipe having a mouthpiece at one end thereof;

a main bore terminating in an instrument bell;

a slide loop;

a casing, said lead pipe, main bore and the ends of said loop being connected to said casing, said casing having a tapered inner surface shaped to provide a rotor seat of arcuate cross section, which surface tapers directly toward the region where one of said lead pipe and said main bore connects to said casing; and a rotor rotatable in said casing having (a) a tapered outer surface that seats against said inner surface for rotational movement in the casing, (b) an axially extending primary rotor passage which directly connects said lead pipe to said main bore when said rotor is in a first position and which connects one end of said loop to said one of said lead pipe and said main bore when said rotor is rotated to a second position, and (c) an axially extending secondary rotor passage which connects the other of said lead pipe and said main bore to the other end of said loop when said rotor is in said second position.

13. The instrument of claim 12 wherein at least one of said surfaces extends substantially the entire axial length of said rotor.

14. The instrument of claim 12 wherein:

said casing includes a casing wall having a generally frustoconical portion which provides said tapered inner surface; and an end of said loop is connected to said casing wall.

15. The instrument of claim 2 or 12 wherein said casing further includes:

a right frustoconical portion which has a base and a narrowed end and which provides said interior contact face, said base being externally threaded, an end plate which covers said base to retain said rotor in the casing and which defines a journal opening to maintain said rotor in axial alignment; and a retainer ring which is internally threaded to mate with said base and hold said end plate in position.

16. The musical instrument of claim 2 or 12 comprising multiple valve assemblies arranged in a series, each including one said casing and one rotor wherein said primary rotor passage is straight, said assemblies being aligned along a common axis such that when each of said rotors is in said first position there is a straight sound path extending through all the valve assemblies in said series.

17. The musical instrument of claim 16 wherein;

said lead pipe connects to the first valve assembly in said series and said main bore connects to the last valve assembly in said series, and at their junctions with said first and last valve assemblies, said lead pipe and said main bore are axially aligned such that when each of said rotors is in said first position, there is a straight sound path extending from within said lead pipe into said main bore.

18. A musical wind instrument having a slide loop, an instrument pipe having a mouthpiece at one end thereof and an instrument pipe terminating in an instrument bell comprising:

a casing having a rotational axis and two opposed interior contact faces that extend transversely to said axis, at least one of said faces forming a coaxial concave rotor seat, one of said instrument pipes being connected coaxially to said casing at said one of said faces, one end of said loop being connected to said casing at said one of said faces at a distance away from said axis, the other of said instrument pipes and the other end of said loop each being connected to said casing at the other of said faces and each being located an equal distance away from said axis, said one of said faces tapering directly toward the region where said one of said instrument pipes is connected to said casing; and a rotor rotatable about said axis in said casing, said rotor being located between said faces and having opposed exterior contact faces that mate with said interior faces respectively for rotational movement therealong, a primary rotor passage which directly connects said one of said instrument pipes to said other of said instrument pipes when said rotor is in a first position and which connects said one end of said loop to said one of said instrument pipes when said rotor is rotated to a second position, and a secondary rotor passage which connects said other of said instrument pipes to said other end of said loop when said rotor is in said second position.

19. A musical wind instrument comprising:

a lead pipe having a mouthpiece at one end thereof;

a main bore terminating in an instrument bell;

a slide loop;

a casing having (a) a casing wall, said wall including a right frustoconical portion having a base and a narrowed end, said frustoconical portion defining a casing axial aperture at said narrowed end and a casing wall aperture at a location between said base and said narrowed end, and said wall including a cylindrical portion extending from said base of said frustoconical portion to a circular casing outer end, said portions having a common axis, (b) a casing end plate having an interior surface which extends normally to said axis, said end plate being secured to said cylindrical portion so that it partially covers an area contained entirely within two adjacent quadrants of said outer end so that said casing wall and said end plate together define an opening in said casing at said outer end, said end plate defining primary and secondary casing end plate apertures spaced an equal distance from said axis, one of said lead pipe and said main bore being connected to said primary end plate aperture, the other of said lead pipe and said main bore being connected to said casing axial aperture, one end of said loop being connected to said secondary end plate aperture, and the other end of said loop being connected to said casing wall aperture; and a rotor dimensional to pass through said opening, said rotor having (a) rotor wall, said wall including a partially right frustoconical portion having a base and a narrowed end, said frustoconical portion defining a rotor axial aperture at said narrowed end and a rotor wall aperture at a location between said base and said narrowed end, said rotor wall also including a right cylindrical portion extending from said base of said frustoconical portion to a rotor outer end, both of said portions being coaxial with said axis, said frustoconical portion of said rotor wall being positioned against said right frustoconical portion of said casing wall, and said axial and wall apertures defined by said rotor wall being in alignment with and of substantially the same size and shape as said axial and wall apertures defined by said casing wall, said rotor wall having an axially-truncated edge, (b) an axially extending rotor sidewall mounted on said rotor wall at said truncated edge so that, in cross section through said truncated edge, said rotor comprises a major arc formed by said rotor wall and a secant formed by said side wall;

(c) a rotor end plate covering said rotor outer end and having a flat outer surface positionable against said interior surface of said casing end plate, said rotor end plate defining primary and secondary rotor end plate apertures in alignment with and of substantially the same size and shape as said secondary and primary casing end plate apertures, (d) a primary rotor tube extending between said rotor axial aperture and said primary rotor end plate aperture, (e) a secondary rotor tube extending between said rotor wall aperture and said secondary rotor end plate aperture, (f) a shaft fixed on said rotor end plate, said shaft being coaxially aligned with said axis whereby said rotor is rotatable in said casing about said axis between a first position wherein said primary rotor end plate aperture registers with said primary end plate aperture and a second position wherein each of said rotor apertures registers with a casing aperture; and a door for at least partially covering said opening to retain said rotor in said casing, said door being removably secured to said casing so that it can be opened for removal of said rotor, at least one of said casing end plate and said door having shaft retaining means for maintaining said shaft in axial alignment when said door is closed.

20. The instrument of claim 19 where said door defines a shaft aperture to receive and journal said shaft.

21. A rotary valve for a musical wind instrument having a slide loop, an instrument pipe with a mouthpiece at one end and an instrument pipe terminating in an instrument bell, said valve comprising:

a casing including (a) a substantially frustoconical casing wall having a base and a narrowed end, said wall tapering directly toward and defining an axial frustrum aperture at said narrowed end and a casing wall aperture at a location between said base and said narrowed end, and (b) a transverse casing end plate at said base of said wall, said end plate defining primary and secondary end plate apertures; and a substantially frustoconical rotor rotatable in said casing having (a) a primary rotor passage which connects said primary end plate aperture to said frustrum aperture when said rotor is in a first position and which connects said secondary end plate aperture with said frustrum aperture when said rotor is rotated to a second position, and (b) a secondary rotor passage which connects said primary end plate aperture to said wall aperture when said rotor is in said second position, said primary end plate aperture connecting to one of said instrument pipes, said frustrum aperture connecting to the other of said instrument pipes, said secondary end plate aperture connecting to one end of said loop, and said wall aperture connecting to the other end of said loop.

22. The valve of claim 21 for a musical wind instrument having a secondary slide loop, a secondary instrument pipe in a sound path connectable with the mouthpiece, and a secondary instrument pipe connectable with said bell, where;

said casing wall defines secondary and tertiary casing wall apertures at locations between said base and said narrowed end;

said casing end plate defines tertiary and quatenary end plate apertures;

said rotor further has (a) a tertiary rotor passage which connects said tertiary rotor end plate apertures to said secondary casing wall aperture when said rotor is in said first position and which connects said tertiary rotor end plate aperture to said tertiary casing wall aperture when said rotor is in said second position, and (b) a quatenary rotor passage which connects said quatenary casing end plate aperture to said secondary casing wall aperture when said rotor is in said second position, said tertiary end plate aperture connecting to one of said secondary instrument pipes, said secondary casing wall aperture connecting to the other of said secondary instrument pipes, said quantenary end plate aperture connecting to one end of said secondary slide loop, and said tertiary casing wall aperture connecting to the other end of said secondary slide loop.

23. The valve of claim 21 wherein:

said primary rotor passage is straight; and at their junctions with said valve, said instrument pipes are axially aligned such that when said rotor is in said first position, there is a straight sound path between the interiors of said instrument pipes.

* * * * *